United States Patent [19]

Walpole

[11] 4,040,004

[45] Aug. 2, 1977

[54] COLOR CODED VEHICLE GUIDANCE SYSTEM

[75] Inventor: Harold L. Walpole, Redondo Beach, Calif.

[73] Assignee: McDonnell Douglas Corporation, Long Beach, Calif.

[21] Appl. No.: 720,844

[22] Filed: Sept. 7, 1976

[51] Int. Cl.[2] ..... G08G 5/00

[52] U.S. Cl. ..... 340/26; 356/151

[58] Field of Search ..... 340/26

[56] References Cited

U.S. PATENT DOCUMENTS

| | | | |
|---|---|---|---|
| 2,458,414 | 1/1949 | Penton | 340/26 |
| 3,412,377 | 11/1968 | Perry | 340/26 |
| 3,648,229 | 3/1972 | Burrows | 340/26 |

*Primary Examiner*—Thomas B. Habecker
*Attorney, Agent, or Firm*—Robert E. Cunha; Walter J. Jason; Donald L. Royer

[57] ABSTRACT

A vehicle guidance system including means for projecting a beam of light to guide a vehicle such as an aircraft on a glide slope, and means for pulse coding the upper the lower portions of the beam providing to the aircraft pilot an indication of the aircraft's position in relation to the glide slope. The upper and lower pulse coded portions of the beam are differentiated by color. Color coded pulses are also provided to differentiate this beam from other lights in the area of the runway.

10 Claims, 13 Drawing Figures

COLOR CODED VEHICLE GUIDANCE SYSTEM

BACKGROUND OF THE INVENTION

The present invention relates generally to aircraft guidance systems and more particularly to an aircraft landing aid that employs a projected beam of light not only to define a glide slope along which a pilot may direct his aircraft in order to touch down at a specific area on a runaway but also to distinguish this projected light beam from other lights typically found in the area surrounding aiports.

One type of aircraft landing aid known generally as a Pulse Coded Optical Landing Aid (PCOLA) is described in commonly owned U.S. Pat. No. 3,648,229 Pulse Coded Vehicle Guidance System, by Burrows, et al. In this system, a series of light choppers are used in conjunction with a source of light and a colored filter to present to the pilot a variety of visual signals to allow him to determine his position relative to the glide slope. If the pilot is within the glide slope, which typically is contained within a vertical angle of approximately 0.3°, the pilot will see a solid white light. If the aircraft is higher than the optimum glide slope but within about three degrees thereof the pilot will see a pulsating white light. Furthermore, the pulses of light will become longer and the intervals between pulses will be shorter as the pilot more closely approaches the glide slope, giving the pilot a visual indication of his angular deviation above the glide slope. Likewise, within an angular distance of about 3°below the glide slope the pilot will see a pulsating red light where the duration of the interval between pulses will become greater as the pilot more closely approaches the glide slope. In this manner the pilot is presented with a continuous indication of his position in relation to the glide slope approaching the runway.

A problem arises in that the pilot is sometimes unable to pick out the Pulses Coded Optical Landing Aid from the clutter of lights, both blinking and steady, that may surround an airport. This is particularly true if the pilot is on course down the glide slope when he will see a steady white light. Some identification schemes have been suggested such as separated beacons but by their nature have been expensive, unattractive and add to the clutter of lights around an airport.

SUMMARY OF THE INVENTION

As a modification to a standard Pulses Coded Optical Landing Aid the instant invention provides for a pulsed green light to be imposed upon the beam that would be visible to the pilot at all times when the pilot were either on the glide slope or above the glide slope. A particular pulse frequency for this green light of approximately one pulse every 3 seconds has been found to clearly identify this system from other lights around the airport. When the aircraft is on the glide slope the indication to the pilot would be a steady white light interrupted by a green pulse every 3 seconds. If the pilot were above the glide slope the indication would be a series of six white pulses followed by one green pulse. In this way the pilot would be able to identify the PCOLA from other lights in the area. No green pulse need be imposed upon the blinking red light indication to the pilot since red pulses are deemed to be distinctive enough to identify this signal from other lights in the area.

This invention is easily implemented within a standard PCOLA system in that the light pulses are ordinarily generated from a steady source of light by an opaque shutter. This shutter may be in a form of opaque saw teeth drawn across the light beam or a shutter mechanically driven across the light beam. In the former case, one of every six or seven saw teeth elements may be replaced by a green filter to accomplish the desired result. Likewise, if a shutter mechanism is used, a cam arrangement is provided so that the beam is interrupted by a green filter for the duration of one cycle for every six cycles of operation of the opaque shutter. In this manner a slight modification to the basic PCOLA system will enable the pilot to clearly differentiate the glide slope indication from other lights in the area of the runaway.

DETAILED DESCRIPTION OF THE INVENTION

Figure 1:
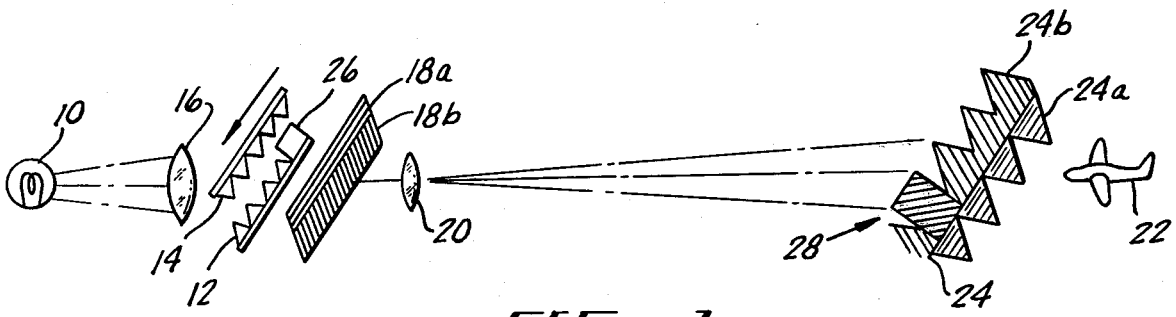
FIG. 1 is a perspective view of the light beam producing apparatus.

FIG. 1 is a fragmentary perspective view of a single beam Pulse Coded Optical Landing Aid as modified according to the instant invention. Light from lamp 10 is directed past the sawteeth 12 and 14 by a condenser lens 16. The light passing between the sweetheeth 12 and 14 can be transmitted through a two section color filter 18 and then projected by objective lens 20 which is suitably adjusted to form an image of the sawteeth pattern at infinity. The sawteeth 12 and 14 are mounted on an endless chain enabling the sawteeth to be driven past the light beam continuously. Filter 18 is divided into a lower half 18A and an upper half 18B resulting in the projection, visible by the pilot of aircraft 22, shown in the diagram as beam 24, comprising an upper half 24B and a lower half 24A. In this specification, elements of the system to the left of the objective lens 20 are referred to as upper elements if they are below the beam center line, and are referred to as lower elements if they are above the center line since the objective lens reverses the beam image.

The modification to this system comprises the substitution of one upper tooth by a rectangular green filter element 26 which results in a green pulse shown in this diagram as a rectangular area of green light 28 in the beam 24. With this modification the indication presented to the pilot is that of a steady white light iterrupted every 2 seconds by a pulse of green light if the aircraft is on the glide slope or a pulse of green light after every six pulses of white light if the aircraft is above the glide slope. The normal frequency of light pulses is three pulses per second so that a green pulse is presented to the pilot every 2 seconds.

Figure 2:
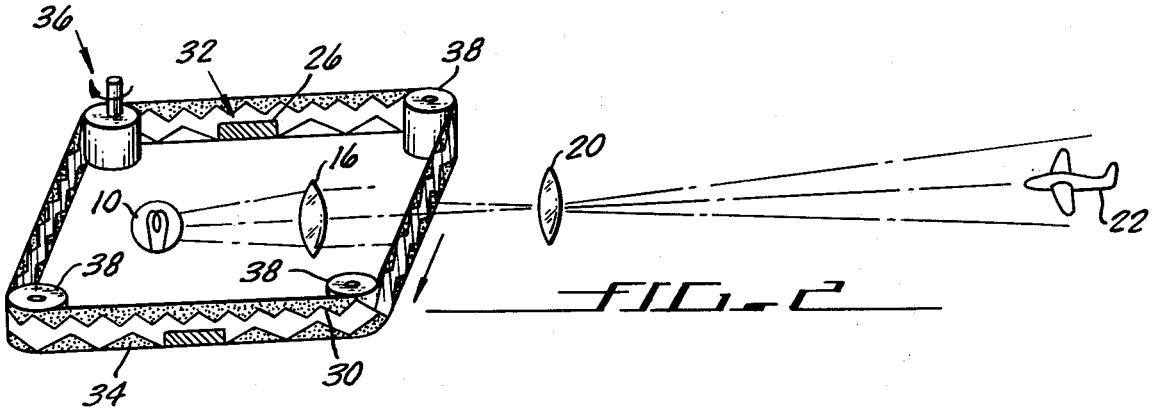
FIG. 2 is a perspective view of an alternate embodiment using an endless film strip.

An alternate embodiment of this invention is shown in FIG. 2 wherein light emanating from a lamp 10 is focused through lens 16 onto a continuous film loop 30 containing a clear area at its center. Opaque triangular areas 32 correspond to the lower mechanical sawtetth 14 of FIG. 1 and upper opaque triangular areas 34 correspond to the upper sawteeth 12 of FIG. 1. In FIG. 2 the light beam, after passing through this film strip, is focused by objective lens 20 for viewing by the pilot of the aircraft 22. The modification to this system comprises the replacement of every sixth saw tooth of the upper half of the film strip with a green filter element 26. This green filter element will extend to the edge of the lower sawteeth 32 so that when the aircraft is either on the glide slope or above it a green light pulse will be visible to the pilot every 2 seconds. The film is continually fed past the light beam by a capstan 36 and three rollers 38.

Figure 3:
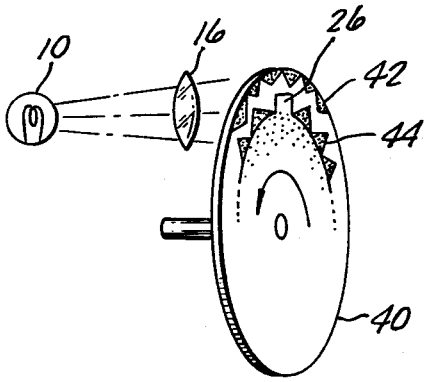
FIG. 3 is a perspective view of an alternate embodiment using a film disk.

An alternate embodiment is shown in FIG. 3 where the film strip is replaced by a film disk 40 on which a lower set of sawteeth 42 and an upper set 44 are driven through the beam generated by a lamp 10 and lens 16. Here again each sixth upper saw tooth is replaced by a green filter element 26.

Figure 5:
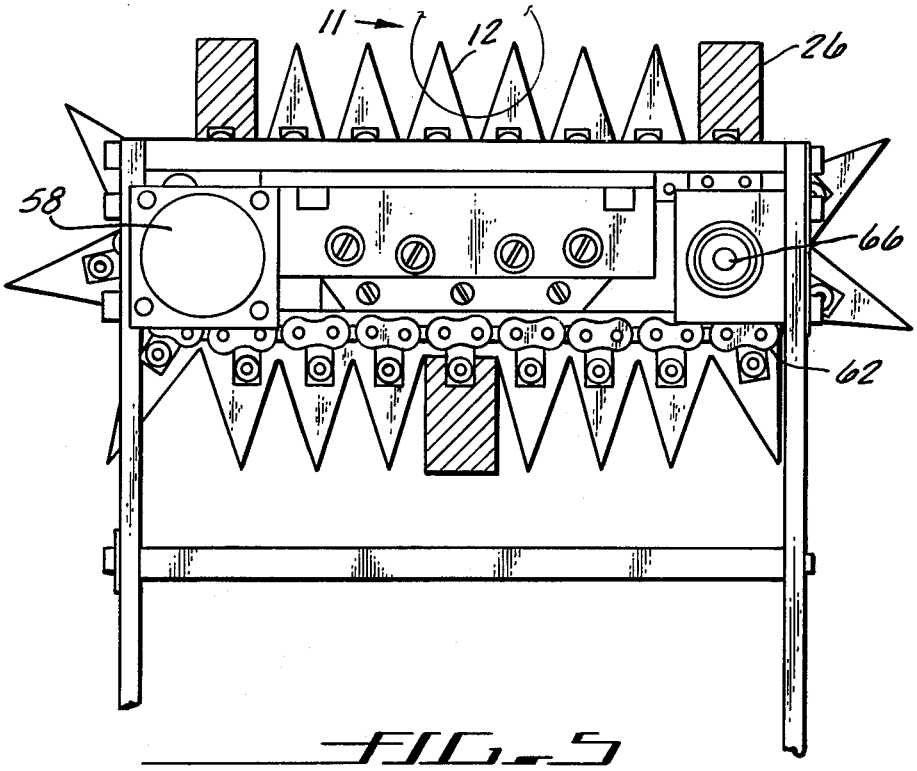
FIG. 5 is a front view of the sawteeth drive mechanism.

FIG. 5 is a detailed front view of the chain drive mechanism for the upper sawteeth 12. The chain drive mechanism for the lower sawteeth 14 is similar except that it is inverted and it does not have the green filter elements 26. The mechanism includes a drive motor 58 which is suitably coupled to shaft and drive sprocket, not shown, which engages the saw tooth chain assembly which includes an endless link chain 62 and sawteeth 12 attached to respective links of the chain. The mechanism further includes an idler sprocket, not shown, mounted on a rotatable shaft 66 that is suitably supported on bearings. Thus, the chain is supported by one sprocket at each end of the inner side of the loop and is driven by the motor 58 which is connected to the left hand sprocket. The beam 11 in this view intersects sawteeth, as shown.

Figure 4:
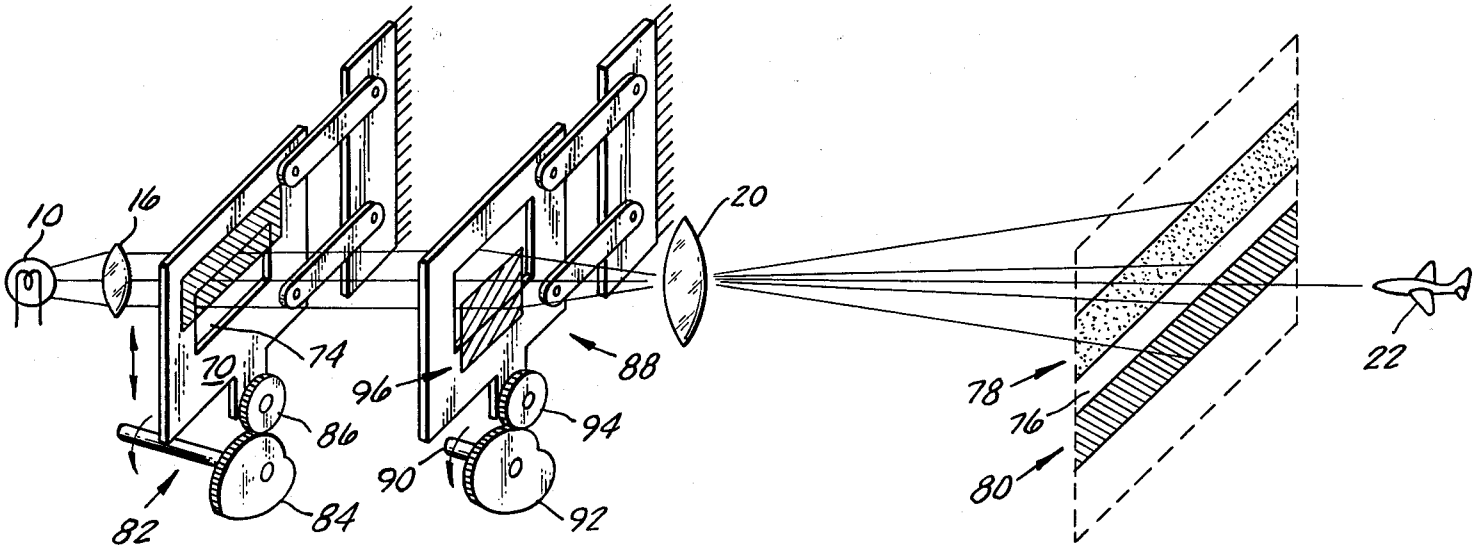
FIG. 4 is a perspective view of an alternate embodiment using rectangular shutters.

An alternate method of producing the desired beam pattern is shown in FIG. 4 where light emanating from lamp 10 is focused through lens 16 onto a first movable shutter 70 and stationary red filter element 72. The height of the rectangular gap 74 is slightly greater than the magnitude of vertical travel of the shutter 70 thereby ultimately producing a light beam visible to the pilot of the aircraft 22 that will be a steady white light 76 if the aircraft is on the glide slope, or a pulsating light 78 and 80 if the aircraft is either above or below the glide slope. Since this lens system inverts the light received from the shutter mechanism before sending it out as a beam visible to the pilot, the positioning of stationary red element 72 to intersect the light beam produces a pulsating red light beam 80 which would be visible to the aircraft if he were below the glide slope.

Since the height of the rectangular gap 74 in the shutter mechanism 70 is larger than the amount of vertical travel of the shutter and since the stationary red filter 72 is positioned so that the edge of the filter is slightly above the center of travel of the rectangular gap, therefore light progressing through the exact center of the lens and shutter mechanism is never interrupted and will appear to the pilot as a steady white light.

The motion of the shutter is produced by the rotation of shaft 82, which rotates at the rate of six rotations per second. This drives cam 84 and follower 86 thereby interrupting the lower and upper portions of the light beam to produce the pulsating light beams 78 and 80.

Interposed between shutter 70 and objective lens 20 is a second movable shutter driven by a second shaft 90, cam 92, and follower 94 arrangement which drivers the second shutter 88 to oscillate in a vertical direction. However, the shaft speed of shaft 90 is one-sixth that of shaft 82 thus interposing the green filter 96 once for every six oscillations of the first shutter 70. Cam 92 is shaped so that the green filter will rise to a point where the edge of the green filter is exactly on a level with the edge of the red filter so that for the duration of each sixth light pulse the indication to the pilot of aircraft 22 will be a green pulse if the aircraft is either within the glide slope or above it. For the remainder of the pulses the cam allows shutter 88 to move downward, removing the green filter 96 from intersection with the beam and allowing the system to present to the pilot either white or red light signals.

Figure 6A:
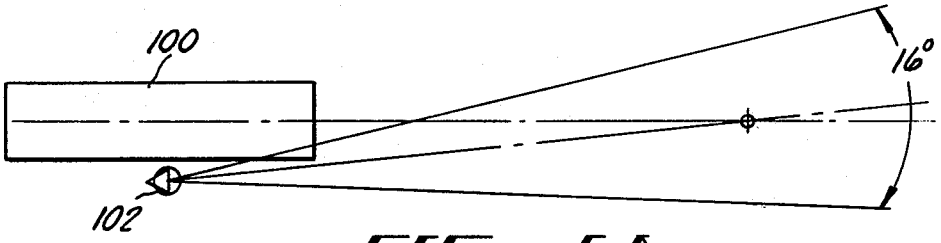
FIGS. 6A, 6B and 6C are detailed of the glide slope beam.
Figure 6B:
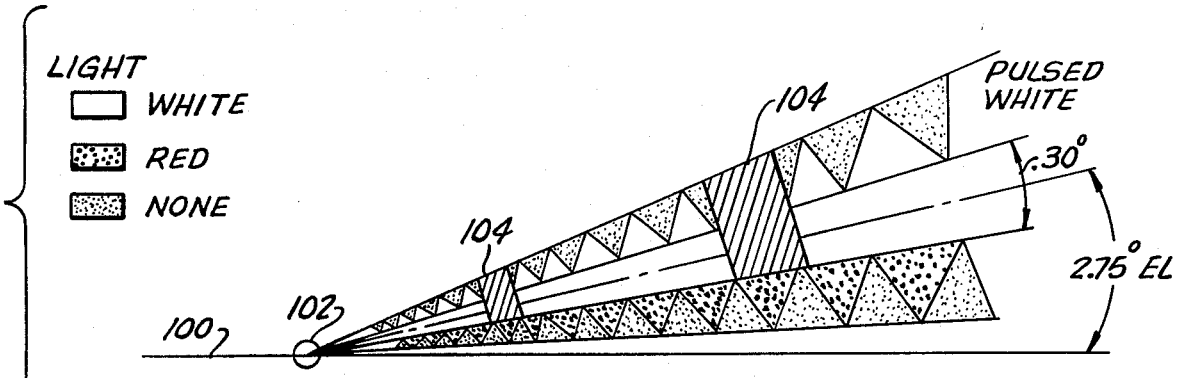
Figure 6C:
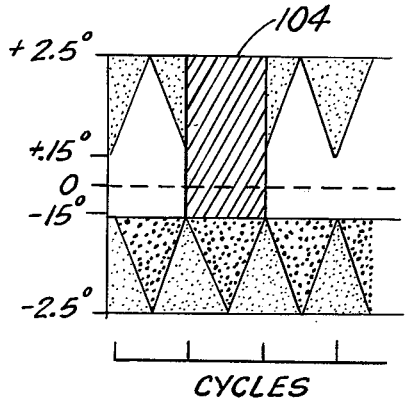

FIGS. 6A, B, and C are detailed top, side and end views of the PCOLA light beam in relation to the end of the runway 100. From the landing pilot's point of view the device generates and projects three horizontal bands of light as shown in FIG. 6C, only one of which can be seen is a steady white light projected as a 0.2° to 0.4° high angular wedge and is 16° wide as shown in FIG. 6A. The center band defines the correct glide path. An upper band of white light pulsing at three pulses per second is a wedge approximately 2.5° high by 16° wide which gives an "above glide path" indication. A similar lower band of red light provides the "below glide path" information. The pulses of white and red "above" and "below" lights vary in length from continuous at the edge of the glide path to zero length at the "off glide path" limit of visual contact. This variation in light pulse length, long near the path, shorter and shorter as deviation from glide path increases, gives the pilot quantitative deviation information. Rate of change of pulse length provides an indication of rate of deviation from and closure with the glide path. To provide an identification of the PCOLA 102 from other lights which might be near it, the steady white beam and the pulsating white beam are interrupted by a green flash 104 every 2 seconds.

FIG. 6A is a top view of the end of the runway and shows the PCOLA 102 at some distance from the end of the runway transmitting a beam approximately 16° wide. FIG. 6 shows a glide path of approxiamtely 2.75° from the vertical, the glide path itself being approximately 0.3° in height bracketed by a pulsed white beam above the glide path and a pulsed red beam below the glide path. As shown, at a rate of one pulse every 2 seconds there will be a green pulse 104 visible to the pilot if the aircraft is either within the glide path or within the pulsed white beam. FIG. 6C is an end view of the beam showing the nominal angular relationships. In this view the aircraft would be represented as a point somewhere within the glide path area and the beam pattern would be moving at a rate from left to right so that the pulses would pass the aircraft at the rate of three per second. Of course the pilot would not perceive this triangular beam pattern, he would see only pulses of light variable in duration. As shown, at a frequency of one pulse every 2 seconds, the pilot would see a green pulse one third of a second in duration if he were either within the glide path or up to 2.5° above it.

Figure 7:
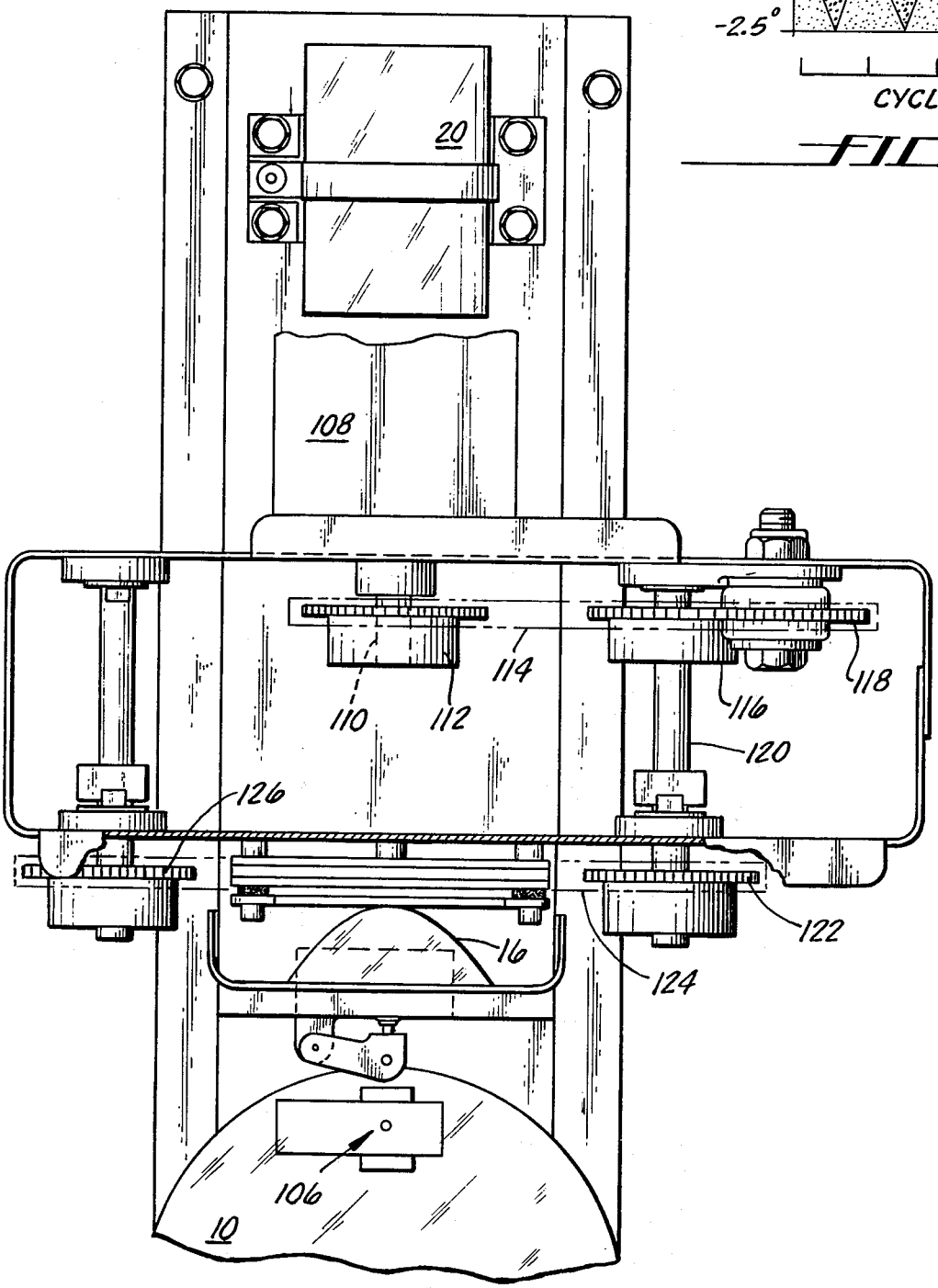
FIG. 7 is a top view of the Pulse Code Generator Assembly.

FIG. 7 is a top view of the pulse code generator assembly. The light is originally generated at the filament 106 of the lamp 10 and transmitted through condenser lens 16 onto the sawtooth plane. The motor 108 is connected through a shaft 110 to a drive sprocket 112 and to a drive chain 114 which rotates sprockets 116 and 118. These in turn are coupled through drive shaft 120 and drive sprocket 122 to drive the chain 124 on which the sawteeth are mounted. An idler sprocket 126 is provided at the other end of the generator assembly. Thus, in this view, the sawteeth would be viewed on end and would proceed horizontally past the light beam directly in front of the condenser lens. The beam, thus interrupted, proceeds through the objective lens 20 which focuses the beam at infinity.

Figure 8:
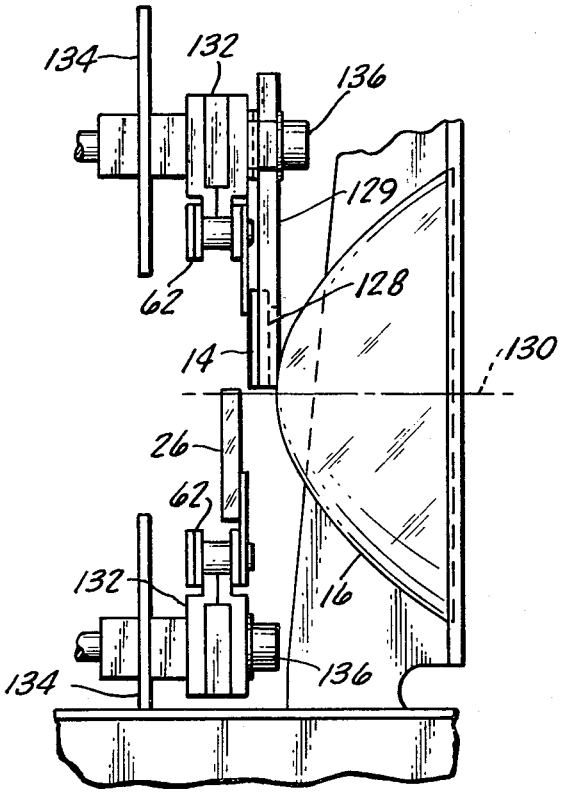
FIG. 8 is a side view of the Pulse Code Generator Assembly.

FIG. 8 is a side view of the pulse code generator assembly shown as a top view in FIG. 7. This figure shows a side view of the stationary red filter 128 supported by a bracket 129. As shown, the bottom of the red filter 128 in the preferred embodiment is approximately 0.03 inches above the beam center line 130. The green filter element 26 is shown in this view as intersecting the beam. The top of the green filter is also 0.03 inches above the beam center line 130. If this view had shown a sawtooth instead of the green filter, the top edge of the sawtooth would be 0.03 inches below the center line of the beam. The sawteeth and green filter element 26 are mounted on a chain 62 which is restrained by a chain guide 132. The upper half of the diagram shows a shutter element 14 directly forward of the red filter glass 128. The edge of the shutter element is 0.03 inches above the beam center line. This shutter element is likewise connected to a chain 62 and is restrained by a chain guide 132 secured by screws 136.

Figure 9:
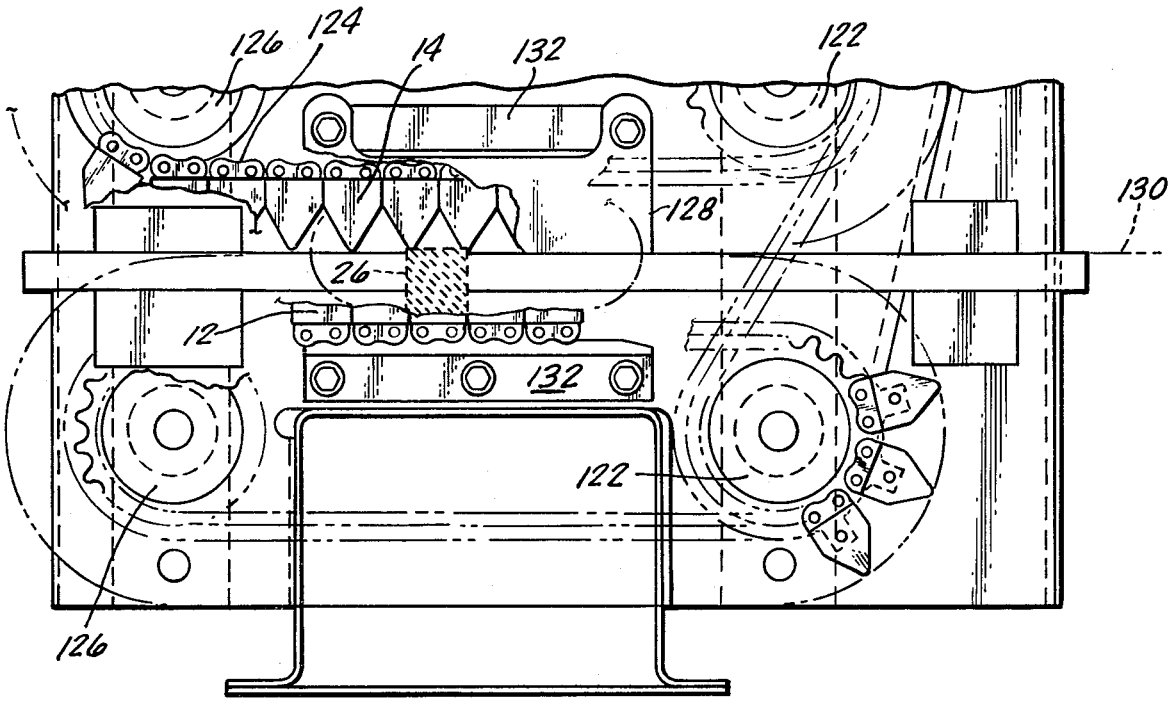
FIG. 9 is a front view of the pulse code mechanism.

FIG. 9 is a front view of the pulse code mechanism. In this view the light beam 24 is represented as an oblong area in the center of the drawing centered about the horizontal center line 30. The upper and lower chains 124 are constrained by chain guides 132 and ride on sprockets 122 and 126. The red filter glass 128 is shown as a partial cutaway, is bolted on the frame, and extends to within 0.03 inches of the horizontal center line 130. Sawteeth 12 are attached to the chain 124 and proceed across the light beam 24. The points of the sawteeth 12 and 14 are 0.03 inches from the center line. In the place of every sixth sawtooth 12 attached to the chain 124 is a green filter element 26 shown in this view as a dotted line rectangular element. The edge of the green filter is 0.03 inches from the horizontal beam center line 130

Figure 10A:
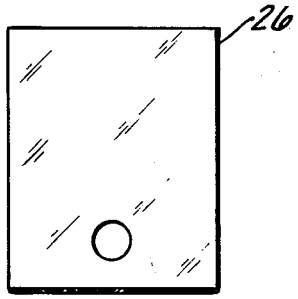
FIG. 10A is a front view of the green filter.
Figure 10B:
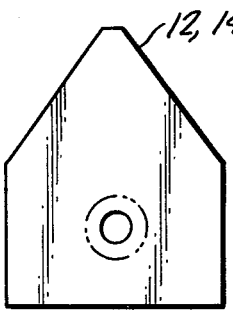
FIG. 10B is a front view of a sawtooth element.

FIG. 10A is a front view of the green filter 26. It is made of optical green filter glass and in the preferred embodiment is approximately three quarters of an inch square and 0.12 inches in thickness. Green filters implemented from either glass or plastic are available. Glass was chosen for this application because of its higher resistance to high temperatures. FIG. 10B is a front view of a saw tooth element 12, 14, and shows the approximate shape required to produce the proper light pulse characteristics.

While an exemplary embodiment of this invention has been described above and shown in the accompanying drawings, it is to be understood that such embodiment is merely illustrative of, and not restrictive on, the broad invention and that I do not wish to be limited in my invention to the specific construction or arrangement described and shown, for various obvious modifications may occur to persons having ordinary skill in the art.

I claim:

1. In a vehicle guidance system wherein a vehicle is directed along a beam of light that establishes the proper path to a selected area, a method of coding said beam comprising the steps of:

projecting a beam of light for establishing said path along which said vehicle is guided, pulse coding at least a cross-sectional portion of said beam over its projected length whereby a pulse coded signal is encountered by said vehicle following said beam on any departure into the pulse coded portion thereof, said pulse coded signal including periodic pulses having a pulse duration in each period varying continuously according to the degree of departure by said vehicle into the pulse coded portion of said beam, and color coding, by the substitution of one color for another at periodic intervals, at least a cross-sectional portion of said beam over its projected length whereby said beam may be distinguished by the operation of said vehicle from other lights in the area of said beam source.

2. A vehicle guidance system comprising:

means for projecting a beam of light along which a vehicle is guided, means for pulse coding at least a cross-sectional portion of said beam over its projected length whereby a pulse coded signal is encountered by said vehicle following said beam on any departure into the pulse coded portion thereof, said pulse coded signal including periodic pulses having a pulse duration in each period varying continuously according to the degree of departure by said vehicle into the pulse coded portion of said beam, and means for color coding by the substitution of one color for another at periodic intervals at least a cross-sectional portion of said beam over its projected length whereby said beam may be distinguished by the operator of said vehicle from other lights in the area of said means for projecting.

3. An aircraft guidance system for producing a beam of light directed along a glide slope to enable the aircraft pilot to follow said beam to a landing area comprising:

means for generating a beam of light and directing said beam from a point near said landing area along the intended aircraft glide slope for viewing by said aircraft pilot, shutter means for periodically obstructing the upper and lower portions of said beam while leaving the center portion of said beam unobstructed, to present to the pilot a visual indication that the aircraft is either above or below the center portion of said beam, a first color filter means placed in the path of said lower portion of said beam to present to the pilot a color indication that the aircraft is below the center portion of said beam, and a second color filter means periodically placed in the path of at least a portion of said beam for presenting to the pilot a color coded indication for differentiating said beam from other lights in the area of said means for generating.

4. The apparatus of claim 3 wherein said shutter means comprises first mechanical means for producing vertical oscillations, and a shutter member containing a rectangular opening positioned so that said beam passes through said opening and connected to said first mechanical means such that the upper portion of said shutter member interrupts the upper portion of said beam when said shutter is at its lowest point of oscillation and interrupts the lower portion of said beam when said shutter is at its highest point of oscillation.

5. The apparatus of claim 4 wherein said second color filter means comprises second mechanical means for producing vertical oscillations, and a second color filter of a color different from said first color filter connected to said second mechanical means and positioned so that the upper and central portions of said beam pass through said second color filter at its lowest point of oscillation and where no portion of said beam passes through said second color filter at its highest point of oscillation.

6. The apparatus of claim 3 wherein said shutter means comprises a series of spaced opaque members transported horizontally across the lower and upper portions of said beam to produce light pulses and wherein said second color filter means comprises a color filter member placed between a preselected member of opaque members transported across the upper portion of said beam to produce one color pulse for each of a preselected number of light pulses in the upper portion of said beam.

7. The apparatus of claim 6 wherein said opaque members and second filter means are implemented from an endless film strip.

8. The apparatus of claim 6 wherein said opaque members and second color filter means are implemented from a film disk.

9. The apparatus of claim 6 wherein said opaque members are formed in the shape of a sawtooth with the point of the sawtooth intersecting the beam at the line between said central and upper or lower portions, and where said second color filter means are rectangular in shape.

10. The apparatus of claim 6 wherein said means for generating comprises a lamp for generating light, a condenser lens for directing light from said lamp through said shutter means and said first and second color filter means, and an objective lens for focusing said beam at infinity.

* * * * *

UNITED STATES PATENT OFFICE
CERTIFICATE OF CORRECTION

PATENT NO. : 4,040,004
DATED : August 2, 1977
INVENTOR(S) : Harold L. Walpole

It is certified that error appears in the above-identified patent and that said Letters Patent are hereby corrected as shown below:

Column 2, line 43, delete [sweetheeth] and insert sawteeth therefor;

Column 3, line 7, delete [sawtetth] and insert sawteeth therefor;

Column 3, line 45, insert condenser before "lens";

Column 4, line 27, after "seen" insert by the pilot at any given instant. The center band;

Column 4, line 50, delete the number [6] and insert 6B therefor.

Signed and Sealed this

Sixteenth Day of May 1978

[SEAL]

Attest:

RUTH C. MASON
Attesting Officer

LUTRELLE F. PARKER
Acting Commissioner of Patents and Trademarks